US007076815B2

(12) United States Patent
Orpilla

(10) Patent No.: US 7,076,815 B2
(45) Date of Patent: Jul. 18, 2006

(54) CURVED SHOWER CURTAIN ROD

(76) Inventor: Serafin W. Orpilla, 86 Highland Ave., Kearny, NJ (US) 07032

( * ) Notice: Subject to any disclaimer, the term of this patent is extended or adjusted under 35 U.S.C. 154(b) by 879 days.

(21) Appl. No.: 10/313,589

(22) Filed: Dec. 9, 2002

(65) Prior Publication Data

US 2004/0107493 A1 Jun. 10, 2004

(51) Int. Cl.
*A47K 3/30* (2006.01)

(52) U.S. Cl. ..... 4/558
(58) Field of Classification Search ..... 4/558, 4/608
See application file for complete search history.

(56) References Cited

U.S. PATENT DOCUMENTS 2,778,030 A * 1/1957 Goche ..... 4/608
4,117,557 A * 10/1978 McPeak et al. ..... 4/610
4,754,504 A * 7/1988 Cellini ..... 4/610
5,662,297 A * 9/1997 Christensen et al. ..... 211/105.1

* cited by examiner

*Primary Examiner*—Charles E. Phillips

(57) ABSTRACT

The CURVE SHOWER CURTAIN ROD is just like a straight curtain rod except the former has its' two ends bent 70 degrees. So, the end points of the whole rod assembly are at the middle of the tub, unlike that of a straight curtain rod, the end points are near the outside of the tub. The curtain of the curved shower curtain rod encloses the tub very well. It eliminates water spilling onto the floor when one is taking shower. It will take only less than a minute to assemble or disassemble the unit. No tool is needed during assembly or disassembly. The rod self supports itself very strongly against the wall. No screw, glue, nail or anything else like hanging bar is needed.

1 Claim, 1 Drawing Sheet

CURVED SHOWER CURTAIN ROD

CROSS-REFERENCE TO RELATED APPLICATIONS

Not Applicable

STATEMENT OF FEDERALLY SPONSORED RESEARCH/DEVELOPMENT

Not applicable.

REFERENCE TO A SEQUENCE LISTING

Not Applicable

BACKGROUND OF INVENTION

In early days, in rich family homes, bathtubs were placed in the middle of the room. Shower curtains ran around the entire tub on curtain rods that hanged from the ceiling.

In this modern time, bathtubs are placed in one small room and it is surrounded by 3 walls. This leaves only one side of the tub to be curtained. Curtains are hanged on straight curtain rods that are mounted between the opposite walls either by the rod itself that is self supporting by pushing itself hard against the wall or using socket mounts on both ends that are screwed to the wall.

Straight curtain rods are mounted along the outside end of the bath tub. The curtain ends, that are very close to the outside of the tub do not stop water from spilling onto the floor when one is taking shower. It would have been better if these curtain ends are deeper inside the tub, to the middle of the tub as an example. The curtain ends will act like shield and the problem of water spilling onto the floor will be greatly reduced.

The curved shower curtain rod is straight in the middle but curved at both ends. The middle of the curtain rod is still along the outside edge of the tub. The ends curve towards inside to the middle of the tub.

BRIEF SUMMARY OF INVENTION

The Curved Shower Curtain Rod is just like a straight curtain rod. The only difference is that the former has its' two ends bent 70 degrees. This makes the curtain of the curved shower curtain rod enclose the tub very much more than the straight rod which curtain ends are close to the outside of the tub.

DETAILED DESCRIPTION OF THE INVENTION

The Curve Shower Curtain Rod is straight in the middle but both ends are curved by an angle of 20 degrees.

Figure 1:
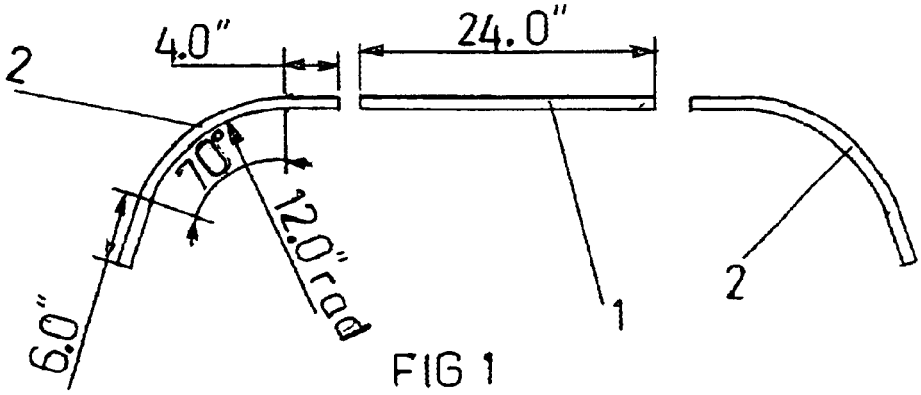
FIG. 1 is an exploded top view of pieces of the curtain rod.
Figure 2:
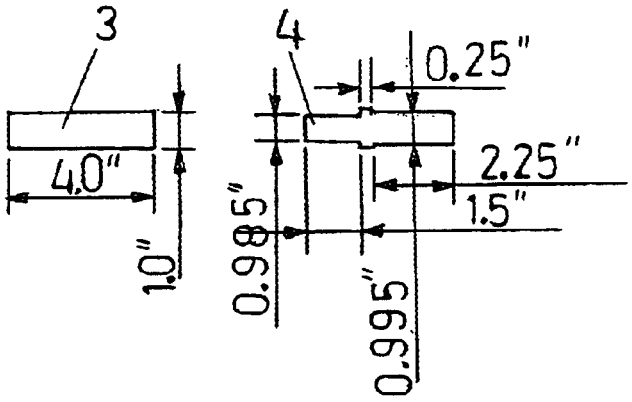
FIG. 2 shows the connector with a cooperating piece of the rod.
Figures 3, 4, 5:
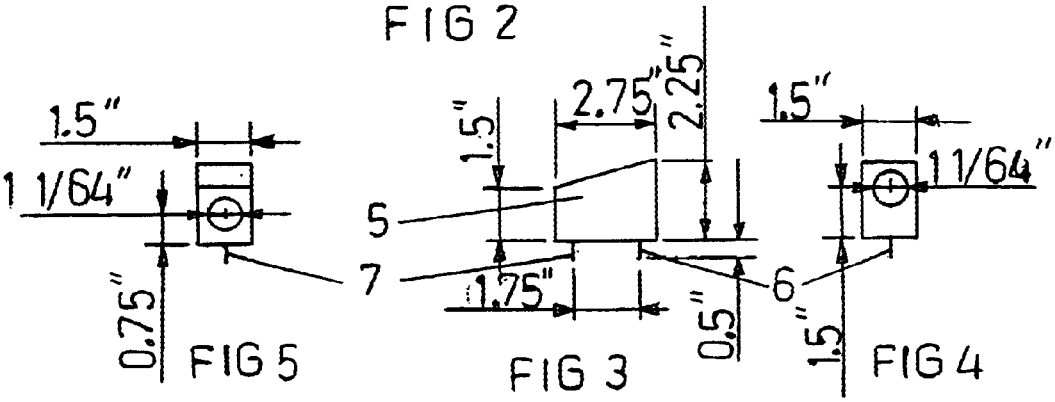
FIG. 3 shows a side view of the base.
FIG. 4 shows an end view of the base.
FIG. 5 shows an opposite end view of the base.

It's made of three major parts, the rod shown in FIG. 1, the connector, shown in FIG. 2 and and the base, shown in FIGS. 3, 4, and 5 in different angles.

The rod is made of Aluminum tube, 1" diameter, 0.035" thick, 24" long as shown in FIG. 1, item 1, which is the center piece of the rod. The curtain rod ends, items 2 of FIG. 1 are made of same material as item 1, but bent with 12" radius tube bender, starting from 4" from one end, and stop at 6" before the other end, making a 70 degree bend.

The connector, item 4 of FIG. 2, is to connect the center piece to the angled rod. The connector is made of solid wood, 1" diameter, 4 inches long, as shown in FIG. 2, item 3. This is cut to item 4 of FIG. 2, which is now the connector itself.

The connector is tightly fitted into the straight rod, by heating the tube ends and inserting the bigger side of the connector into the tube. When the tube cool down, the connector is tightly fitted in the rod.

Another major piece of the Curved Shower Curtain Rod is the base. It is made from a solid wood, with side view of the shape shown in FIG. 3, item 5. A 1/64" hole is frilled from the high side as shown by the front view in FIG. 4. The hole is drilled an an angle of 20 degree in reference to the bottom of the base, to the other end as shown in FIG. 5, which is the front view of the lower side. The bottom of the base is provided with 2½" long metal pins, items 6 and 7, in the positions shown in FIGS. 3,4 and 5. A 1" long pin, is screwed into the base, until ½" is left out.

Figure 6:
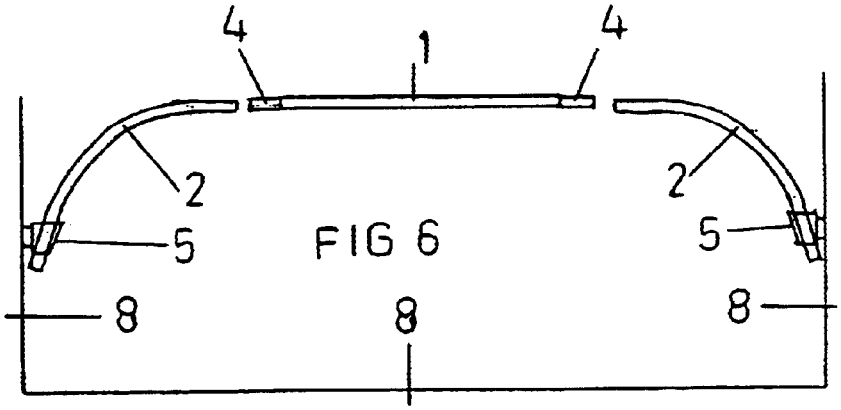
FIG. 6 shows the rod positioned in a shower environment.

The assembly of the rod is shown in FIG. 6, bounded by the bathroom walls, item 8. Shown are 3 separated parts. The center piece is the straight rod with connectors already in it. The other two are the curved ends, whose longer side, the 6" straight section, are already inserted through the base. The 3 separated pieces can be reduced to two separated pieces by assembling only one curved rod with the center piece, that is inserting item 4 into item 2 of FIG. 6.

To complete the assembly of the two separate pieces, only one person is needed. But holes on the walls are needed to plug into the pins of the bases. Insert the pins of the bases into corresponding holes. Assemble the two pieces together by pulling back the curved rod until its' other end has the connector, item 4, inside. After the assembly, pull the rod assembly away from the tub. This will create a pressure pressing on the bases against the wall. As the rod assembly is pulled away, the overall length of the rod between the bases increases. As it increases, it also increases the pressure on the base and the tension along the rod. The rod will support itself in that condition. To disassemble the rod, just push back the assembly towards the tub until item 4 comes off item 2.

I claim:

1. A curved curtain rod assembly comprising of; two pieces of 24 inch long metallic tube, 1 inch in diameter, 0.035 inch thick and each a radius having bend of 12 inches starting 6 inches from one end and ending after 70 degree bend leaving the other end as a 4 inches straight piece, one of 24 inch long metallic tube, 1 inch in diameter, 0.035 inch thick and straight; two pieces of round, solid connectors, 4 inches long, one end having a 0.995 inch diameter that runs 2.25 inches long and the other end is 0.985 inch diameter that runs 1.5 inches, leaving a section of 0.25 inch long with 1.00" diameter; and two pieces of base, 2 inches wide by 3 inches long by 2 inches in height each having a 1/64 inch diameter hole drilled along the entire length of the base at an angle of 20 degrees in reference to the base and each base has two metal pins, 1 inch long attached to the base with ½ inch of each pin sticking out of the base the pin being spaced at 0.75 inch apart, along the center of the length of the base.

* * * * *